US011192768B2

(12) United States Patent
Poeschl et al.

(10) Patent No.: US 11,192,768 B2
(45) Date of Patent: Dec. 7, 2021

(54) QUALITY CONTROL WHEN FILLING A CONTAINER WITH A FILLING PRODUCT

(71) Applicant: KRONES AG, Neutraubling (DE)

(72) Inventors: Florian Poeschl, Neutraubling (DE); Florian Herrmann, Neutraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 17/012,517

(22) Filed: Sep. 4, 2020

(65) Prior Publication Data

US 2021/0070597 A1 Mar. 11, 2021

(30) Foreign Application Priority Data

Sep. 5, 2019 (DE) ..... 10 2019 123 781.5

(51) Int. Cl.

| | |
|---|---|
| ***B67C 3/10*** | (2006.01) |
| ***B67C 3/12*** | (2006.01) |
| ***B67C 3/00*** | (2006.01) |
| ***B67C 3/16*** | (2006.01) |

(52) U.S. Cl.

CPC ..... *B67C 3/12* (2013.01); *B67C 3/007* (2013.01); *B67C 3/10* (2013.01); *B67C 3/16* (2013.01)

(58) Field of Classification Search

CPC .... B67C 3/12; B67C 3/10; B67C 3/16; B67C 3/22

See application file for complete search history.

(56) References Cited

U.S. PATENT DOCUMENTS 3,927,700 A * 12/1975 Trinne ..... B67C 3/244 141/5
6,192,946 B1 * 2/2001 Clusserath ..... B67C 3/12 141/40
2011/0197996 A1 * 8/2011 Clusserath ..... B67C 3/2614 141/311 R

FOREIGN PATENT DOCUMENTS

| | | |
|---|---|---|
| EP | 0979797 | 2/2000 |
| EP | 2722304 | 4/2014 |
| WO | WO 94/26651 A1 | 11/1994 |
| WO | WO 2009/068144 A1 | 6/2009 |
| WO | WO 2011/080483 | 7/2011 |

OTHER PUBLICATIONS

Extended European Search Report dated Feb. 18, 2021, European Patent Application 20194856.9, 8 pages.

* cited by examiner

*Primary Examiner* — Jason K Niesz
(74) *Attorney, Agent, or Firm* — Haynes and Boone, LLP

(57) ABSTRACT

A device for filling a container with a filling product (e.g., in a beverage filling system), includes: a product tank for providing the filling product, wherein a head space with a gas atmosphere is located above the filling product in the product tank; at least one filling member with a filling valve which is fluidically connected to the product tank for introducing the filling product from the product tank into the container to be filled and a gas channel for treating the container to be filled with a gas and/or for discharging gas from the container; a measuring apparatus for analyzing the gas atmosphere in the head space; and a control apparatus which is communicatively coupled to the measuring apparatus and which is designed to determine a process performance, (e.g., a quality of the filled filling product), from the analysis of the gas atmosphere in the head space.

20 Claims, 2 Drawing Sheets

QUALITY CONTROL WHEN FILLING A CONTAINER WITH A FILLING PRODUCT

CROSS REFERENCE TO RELATED APPLICATIONS

This application claims priority from German Patent Application No. DE 10 2019 123 781.5, filed on Sep. 5, 2019 in the German Patent and Trademark Office, the disclosure of which is incorporated herein by reference in its entirety.

BACKGROUND

Technical Field

The present invention relates to a device and a method for filling a container with a filling product, for example in a beverage filling system for filling beverages, such as for example water, which is carbonized or non-carbonized, soft drinks, wine, beer or mixed beverages.

Related Art

It is known to treat, for example to flush and/or to pressurize, a container with a process gas before it is filled with a filling product. Different process gases, such as for example carbon dioxide, nitrogen or oxygen, may be used depending on the filling product. Before the filling, it is also important to remove undesired gases as thoroughly as possible from the interior of the container. Thus a low-oxygen filling process is desired, for example, for wine or beer. Since it may arise that the concentration and composition of the process gases is altered during the filling operation, container treatments using a process gas also influence the quality of the filled filling product. Thus, for example, the absorption of oxygen by the filling product may gradually change in the aforementioned example of beer and wine; a reduction in quality which normally is able to be tested and assessed only by complex measurements after the filling process.

In order to monitor the quality of the filling product during the filling, WO 2009/068144 A1 proposes to arrange a measuring device in a return line in which the filling product is conducted through a filling tank in a circulating manner. The measuring device is designed, for example, to measure the sugar content, the turbidity, the content of carbon dioxide or the temperature of the filling product. It is disclosed in WO 94/26651 A1 to measure the oxygen content in the container to be filled.

The filling process may be influenced by monitoring the filling product quality during the filling. Thus in the case of a carbon dioxide content which it too low in the filling product, established by the measuring device in the return line, it is disclosed in the aforementioned WO 2009/068144 A1 to supply carbon dioxide additionally by a metering device.

A difficulty therein, however, is taking into consideration the quality of the process gases for pretreating the containers when determining the quality of the filled product. Thus the exact gas composition in the product tank is normally unknown and may only be estimated by approximate calculations. In addition, the gas composition in the product tank may be altered, for example, due to gas flowing back from the treated and filled containers. Since it is desirable that different filling processes may be carried out by one filling system, and the filling processes may differ significantly from one another, for example regarding carbon dioxide flushing, purging, evacuation, filling pressure, filling temperature and the like, an accurate determination of the process gas composition, in particular of the residual gas in the container, which may be absorbed by the filling product, is almost impossible by calculation. A sensor system potentially present in each filling station would involve high costs and also barely permit conclusions to be drawn about the entire system.

SUMMARY

The present disclosure describes improvements in the filling of a container, for example in a beverage filling system, in particular to ensure a uniform quality of the filled products with low effort in terms of mechanical engineering.

The method and the device described herein serve for filling a container with a filling product. In various embodiments, the filling product is a beverage, such as for example water, which is carbonized or non-carbonized, soft drinks, wine, beer or mixed beverages.

The device includes a product tank for providing the filling product. The product tank is generally rotatably arranged about a rotational axis. Alternatively, the product tank may also be rigidly arranged. The product tank has, for example, a kettle shape or annular shape. A head space with a gas atmosphere is located above the filling product in the product tank, said gas atmosphere having normal pressure (i.e. approximately 1 bar), overpressure or negative pressure relative to normal pressure. Spatial terms, such as for example "above", "below" and the like, are clearly determined by the installed position of the device and the direction of gravity. The device also has at least one filling member with a filling valve which is fluidically connected to the product tank. The one or more filling members serve for introducing the filling product from the product tank into the container(s) to be filled. The one or more filling members also have in each case a gas channel for treating the container to be filled with a gas and/or for discharging gas from the container, generally partially or fully into the product tank. The product tank and the filling members are typically components of a filling machine having a carousel-type design.

The device according to several embodiments further includes a measuring apparatus for analyzing the gas atmosphere in the head space of the product tank and a control apparatus which is communicatively coupled and/or connected to the measuring apparatus and which is designed to determine a process performance, for example a quality of the filled filling product from the analysis of the gas atmosphere in the head space of the product tank.

In other words, by the analysis and/or monitoring of the gas atmosphere in the product tank conclusions may be drawn about the process performance, in particular the quality of the filled products. As a result, this provides an independence from expensive and often unreliable analysis devices which evaluate the filled products retrospectively. The process performance determination using the gas atmosphere in the product tank may be used instead of or in addition to the conventional quality control. A potential optimization of the treatment process including, for example, flushing and/or pressurizing and/or filling of the containers, may be carried out in real time and in an automated manner, whereby the effort of a retrospective quality control is eliminated or at least may be reduced. In this manner, the number of containers which are retrospectively rejected due to problems of quality may be reduced. The effects of different gas compositions on the filling may be examined in a targeted manner. Faulty processes may be automatically detected and superfluous process steps, for example an evacuation and $CO_2$ flushing, may be optimized or even eliminated. In this manner, not only the process sequence may be optimized as a whole, but the consumption of resources, for example the $CO_2$ consumption, may be minimized.

In various embodiments, the control apparatus is designed to alter the treatment of the container, including for example the filling and/or a flushing and/or a pressurizing of the container with a gas, such as carbon dioxide, nitrogen or oxygen, as a function of the process performance determined by the control apparatus. In this manner, an optimization of the treatment process may be carried out during the regular operation of the device.

Thus the measuring apparatus generally has at least one gas sensor which is designed to determine the gas composition in the head space of the product tank or which contributes thereto. The gas composition in the product tank, in particular the alteration of the gas composition over the course of time, enables conclusions to be drawn about the gas atmosphere in the container to be filled and thus also about the filling product quality in the filled container.

In certain embodiments, the gas sensor is an oxygen sensor, wherein the control apparatus in this case is designed to determine the process performance by taking into account the quantity of oxygen in the head space of the product tank. The term "quantity of oxygen" encompasses all variables which are a measurement of the absolute oxygen volume, oxygen content, oxygen component and the like, in the head space of the product tank. Thus the quantity of oxygen and/or residual oxygen in the product tank may be regarded as an indicator of the oxygen content in the container to be filled, since this passes directly into the product tank, for example by displacement by the filling product. For example, a low-oxygen filling process is very important for wine or beer. Since it may arise that during the course of the filling operation the concentration and composition of the process gases are altered, container treatments, such as for example flushing and/or pressurizing of the containers, also influence the quality of the filled filling product. By analyzing the oxygen content in the product tank, therefore, the oxygen absorption by the filling product may be estimated in advance and, when an absorption of oxygen which is too great is anticipated, an optimization of the process may be undertaken.

If the oxygen content rises in the product tank, for example, an impairment to the product quality may be counteracted by a flushing time of the container, typically with carbon dioxide, being lengthened, a potential vacuum in the container and/or a pressurizing of the container being optimized.

In some embodiments, the gas channel is fluidically connected to the product tank so that gas which is displaced from the container during the filling process, and/or is released during a depressurization of the container after the filling, passes through the gas channel into the head space of the product tank. In this manner, the gas atmosphere in the product tank is directly related to the gas atmosphere in the containers, whereby the accuracy and reliability of the analysis methods set forth herein are further improved.

A method for filling a container with a filling product, for example in a beverage filling system, is described herein according to various embodiments. The method includes: providing the filling product in a product tank, wherein a head space with a gas atmosphere is located above the filling product in the product tank; introducing the filling product from the product tank through a filling valve of a filling member into the container, wherein the filling member also has a gas channel for treating the container before the filling and/or for discharging gas from the container, generally partially or entirely into the product tank; analyzing the gas atmosphere in the head space of the product tank by means of a measuring apparatus; and determining by means of a control apparatus, which is communicatively coupled to the measuring apparatus, a process performance, for example a quality of the filled filling product, from the analysis of the gas atmosphere in the head space of the product tank.

The features, technical effects, advantages and exemplary embodiments which have been described relative to the device, apply equally to the method.

Thus for the aforementioned reasons, generally the treatment of the container, including for example the filling and/or a flushing and/or a pressurizing of the container with a gas, for example carbon dioxide, nitrogen or oxygen, may be altered and/or adapted as a function of the process performance determined by the control apparatus.

Generally for the aforementioned reasons, the measuring apparatus has at least one gas sensor, wherein the analysis of the gas atmosphere in the head space of the product tank typically includes a full or partial determination of the gas composition in the head space.

In certain embodiments, for the aforementioned reasons, the gas sensor is an oxygen sensor, wherein the process performance is typically determined by taking into account the quantity of oxygen in the head space of the product tank.

In some embodiments, for the aforementioned reasons in the case of a rising quantity of oxygen in the head space of the product tank a flushing time of the container, generally with carbon dioxide, is lengthened and/or a vacuum in the container and/or a pressurizing of the container is optimized.

In various embodiments, for the aforementioned reasons, the gas channel is fluidically connected to the product tank, wherein gas which is displaced from the container, for example, during the filling process and/or is released during a depressurization of the container after the filling, passes through the gas channel into the head space of the product tank.

Further advantages and features of the present invention may be derived from the following description of exemplary embodiments. The features described therein may be implemented individually or in combination with one or more of the features set forth above, insofar as the features do not contradict one another. In this case, the following description of exemplary embodiments is carried out relative to the accompanying drawings.

BRIEF DESCRIPTION OF THE FIGURES

Further embodiments of the invention are described in more detail by the following description of the figures.

DETAILED DESCRIPTION

Figure 1:
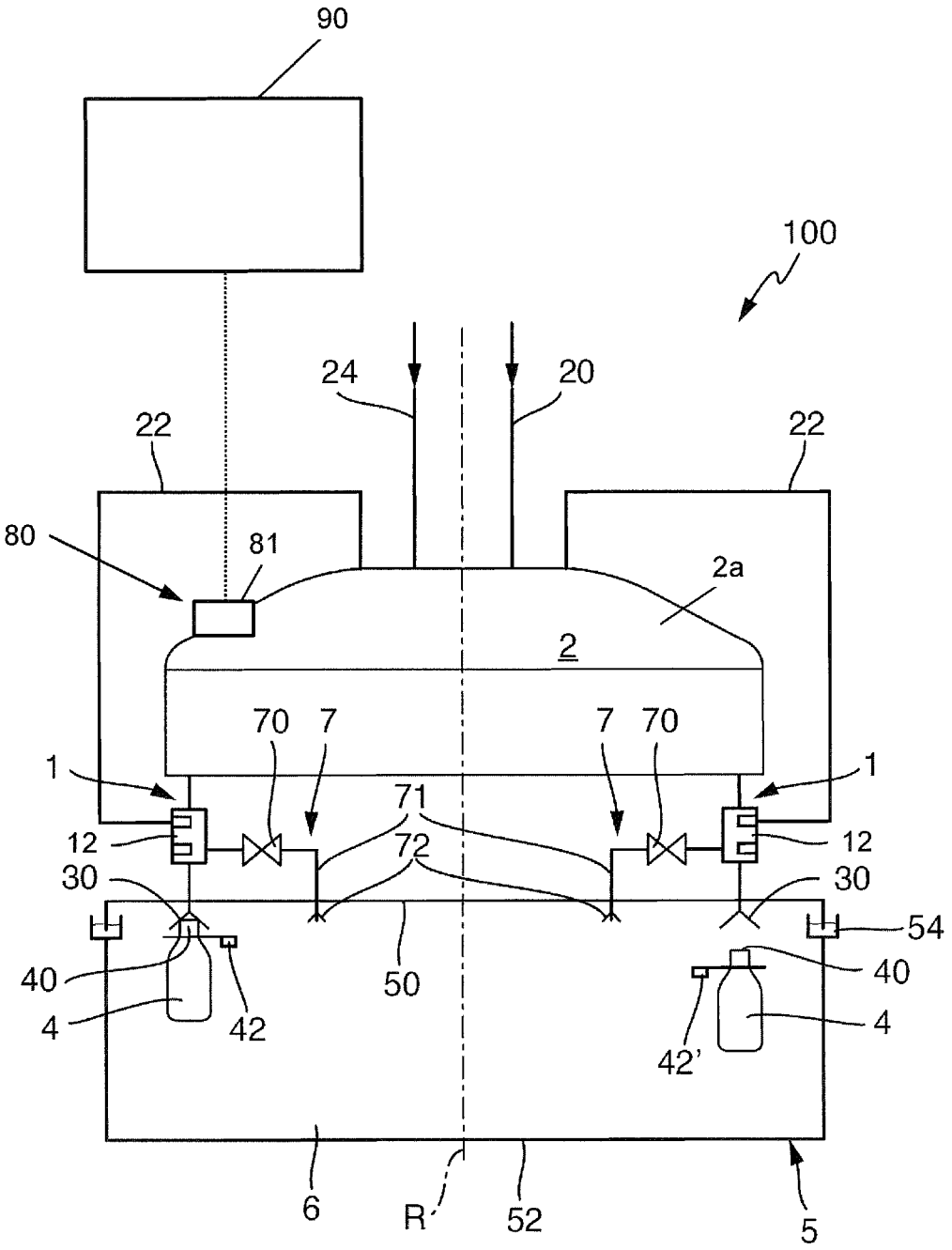
FIG. 1 shows schematically a carousel-type filling machine for filling a container with a filling product in an isolator according to an exemplary embodiment.

Exemplary embodiments are described hereinafter with reference to the figures. In this case, elements which are the same, similar or have the same function are denoted by identical reference numerals. In order to avoid redundancies, a repeated description of these elements in the following description is dispensed with in some cases.

FIG. 1 shows schematically a carousel-type filling machine 100 with a plurality of filling members 1 for filling in each case a container 4 to be filled with a filling product. Via a product inlet 20 a product tank 2, for example the schematically shown central tank, is supplied with the filling product to be filled into the container 4 to be filled. The filling product is, for example, a carbonized filling product, such as for example soft drinks, mineral water, wine or beer.

The product tank 2 has a head space 2*a* above the filling product in which a gas atmosphere is located, the composition thereof being able to be altered during the course of regular operation of the carousel-type filling machine 100, i.e. during the filling process. Thus it is possible, for example, that a $CO_2$ atmosphere in the head space 2*a* is contaminated by air, i.e. oxygen, which is displaced from the containers 4 into the product tank 2 during the filling.

Since at atmospheric pressure carbonic acid is released from the filling product, in the case of filling carbonized filling products, the product tank 2 is generally subjected to overpressure via a pressurizing gas supply line 24 by introduced pressurizing gas. In this case, carbon dioxide is provided as the pressurizing gas, but alternatively other gases such as nitrogen or oxygen may also be provided as the pressurizing gas. Accordingly, the product tank 2 is at overpressure and, via the filling product, for example a $CO_2$ atmosphere is present at a sufficiently high pressure which prevents a discharge of $CO_2$ from the filling product, so that correspondingly a filling product with the desired carbonization is present at the filling members 1, which then may be accordingly filled into the containers 4 to be filled.

The product tank 2 is connected to a filling valve 12 of the corresponding filling member 1, a container 4 to be filled being filled thereby with the filling product. The container 4 to be filled is received in a container receiver 42 and is pushed thereby with its container opening 40 and/or neck against an outlet opening 30 of the filling valve 12 such that a liquid-tight and gas-tight contact is produced between the outlet opening 30 and the container opening 40.

In order to prevent that $CO_2$ is discharged from the filling product during filling and correspondingly that during the filling process a high degree of foaming of the filling product takes place which would prevent an efficient filling, the container 4 to be filled is typically pressurized with the pressurizing gas. The pressurizing gas, for example, may be conducted from the product tank 2 via a pressurizing gas line 22 via a valve provided on the filling valve 12 to the container 4 to be filled, which is already pushed against the outlet opening 30 in a gas-tight manner. When the filling valve 12 is open the pressurizing gas is then discharged through the filling product flowing into the container 4 via a gas channel (see FIG. 2), and generally displaced back again into the product tank 2 where it passes into the head space 2*a* of the product tank 2. This process is also denoted as "counter-pressure filling". In other words, the filling product is filled from the product tank 2 at overpressure into a container 4 to be filled which is also at overpressure.

Before releasing the container 4 thus filled from the outlet opening 30, the pressure prevailing in the container 4 is accordingly released in a controlled manner in order to counteract an excess discharge of $CO_2$ in this phase. With a sudden release of the gas-tight connection between the container opening 40 and the outlet opening 30, the overpressure would be suddenly reduced, whereby an abrupt discharge of a portion of the $CO_2$ released in the filling product would be caused and correspondingly a portion of the filling product may escape and/or overflow from the container 4. By the controlled release of the overpressure, which is also denoted as "pressure relief" or "depressurization", it is possible to counteract this overflow.

In order to protect the filling product even further in the case of products which are sensitive to oxygen, before the actual pressurizing, the container 4 to be filled may also be flushed with an inert flushing gas—for example also with $CO_2$—before the filling. A flushing of the container 4 may also be carried out in cases where a pressurizing is not required.

The "counter-pressure filling" set forth above is only by way of example. Thus it is possible, for example, in particular for filling non-carbonized filling products, to introduce the filling product into the container 4 without overpressure, and solely by the static pressure thereof. Similarly, the container 4 does not necessarily have to be at overpressure during filling.

In the present exemplary embodiment, the carousel-type filling machine 100 has an isolator 5, a substantially sterile region 6 being provided in the interior thereof. In this case, the outlet opening 30 of the filling valve 12 and the container receiver 42 and the container 4 are arranged in the sterile region 6 so that an aseptic filling of the filling product may be carried out into the container 4 to be filled. In other words, the open container 4 to be filled may be initially transported in a sterile atmosphere to the container receiver 42, received thereby and then pushed against the outlet opening 30. After filling, the container 4 thus filled may be released again from the outlet opening 30 and transported further in the sterile atmosphere to a closing device arranged downstream. By the provision of the isolator 5 and the sterile atmosphere provided therein, accordingly the germ load of the containers 4 to be filled and of the filled container 4 and of the filling product received therein may be minimized so that the filling product obtains the longest possible shelf life.

As the container 4 and the outlet opening 30 are guided in the sterile atmosphere, it is possible to counteract a contamination of these elements. The sterile region 6 is substantially at atmospheric pressure, wherein in the sterile region 6 generally a slight overpressure is provided in comparison with the unsterile atmosphere outside the isolator 5 in order to ensure that at any leakage points or at transfer locks for the transfer of the containers 4 into the sterile region 6 no contaminating substances pass into the sterile region 6.

Moreover, a further container 4 which is received in a further container receiver 42' is shown in FIG. 1. The further container receiver 42' is located in a lowered state in comparison with the container receiver 42 so that the container 4 and the outlet opening 30 are spaced apart from one another. The container receiver 42' in this case is located in a transfer position for the transfer of the containers 4, in which containers 4 to be filled are taken from an inlet starwheel, not shown, and filled containers 4 are transferred to an outlet starwheel, not shown. In the carousel-type filling machine 100 shown, the transfer positions for the removal and return are located adjacent to one another so that a large treatment angle is provided for treating the containers 4. The product tank 2 in this case is arranged rotatably around a rotational axis R. Alternatively, the product tank may also be rigidly arranged and the filling product conducted via a rotary distributor to the individual rotating filling valves. It is also possible to provide the product tank as a rotating annular container.

The filling members 1 which are arranged fixedly on the product tank 2 rotate with the product tank 2 as a result of the design. The filling valves 12 are connected in a gas-tight manner to a rotating isolator cover 50 which is sealed in a gas-tight manner by a dynamic seal, for example in the form of a surge tank 54 relative to a rigidly arranged isolator pan 52. The outlet openings 30 in this case are arranged such that they are surrounded by the sterile region 6.

The carousel-type filling machine 100 of FIG. 1 also has a pressure relief arrangement 7 which is connected to the filling valve 12. A pressure relief valve 70 is provided in order to control and/or regulate the opening and closing of a gas path through the pressure relief arrangement 7. The pressure relief arrangement 7 in this case has a pressure relief line 71, the outlet opening 72 thereof opening into the sterile region 6 through the isolator cover 50. Thus during the pressure relief of the filled container 4, before releasing the gas-tight connection between the container opening 40 and the outlet opening 30 of the filling valve 12, the pressurizing gas is directly vented into the sterile region 6.

By this arrangement it is prevented that during the pressure relief of the container 4 it results in a contamination of the filling product, since the outlet opening 72 of the pressure relief arrangement 7 does not come into contact with the unsterile atmosphere and thus no germs pass into the pressure relief arrangement 7. It may also be excluded that during longer production cycles, a biofilm forms in the pressure relief arrangement 7 which grows on the pressure relief line 71 as far as the filling valve 12 and which ultimately contaminates the filling product and/or the container 4 to be filled. Thus, in comparison with the prior art, an improved hygiene of the carousel-type filling machine 100 is achieved in a simple manner.

The pressure relief line 71 is provided with an incline so that product particles and/or product aerosols may slide down due to the incline and thus a biofilm, which would contaminate parts of the carousel-type filling machine 100 and/or the filling product, may not be formed. Moreover, it is achieved thereby that condensate of a gas or vapor or a cleaning fluid which is used for cleaning the carousel-type filling machine 100 is able to drain out entirely from the pressure relief arrangement 7 on the inner walls of the pressure relief arrangement 7.

Moreover, a throttle arrangement is provided in the pressure relief arrangement 7, a volumetric flow of the pressurizing gas to be conducted out of the filled container 4 being able to be regulated thereby in order to achieve a controlled venting and thus to prevent a foaming of the filling product and thus a loss of filling due to the pressurizing pressure being reduced too rapidly. Thus the pressure relief may be optimally set relative to the filling product to be filled and the container 4 and, for example, the pressure relief path may be set relative to the saturation pressure of the filling product.

Different treatment regions in which the container 4 is subjected to different treatment steps are provided within the treatment angle on the carousel-type filling machine 100. After pretreatment steps such as sterilizing, evacuating and/or intermediate flushing, the container 4 is generally pressurized by means of the pressurizing gas from the product tank 2. Subsequently the filling valve 12 is opened and the filling of the container 4 to be filled with the filling product starts. After the filling process is completed, together with a potentially required filling level correction, the containers 4 have to be settled and relieved of pressure. The following settling and pressure relief phase serves to reduce the filling pressure in order to avoid a discharge of $CO_2$ from the filling product and the loss of filling associated therewith by foam formation. In the settling time, $CO_2$ present in gaseous form may rise in the filling product so that with the pressure relief it does not result in foam formation. Depending on requirements, the pressure relief may also be carried out in a plurality of steps or stages. After pressure relief of the head space of the container 4 via the pressure relief arrangement 7, the pressure prevailing in the sterile region 6 is present again in the container 4. Subsequently, the container 4 is brought into the transfer position by lowering the container receiver 42 and then is generally transferred to a closing device arranged downstream.

It should be mentioned that alternatively the pressure relief may be carried out into the external surroundings or even into the product tank 2. Moreover, the isolator 5 placed therein is optional. The isolator is advantageous if a particularly hygienic filling is required but optionally may be dispensed with.

Figure 2:
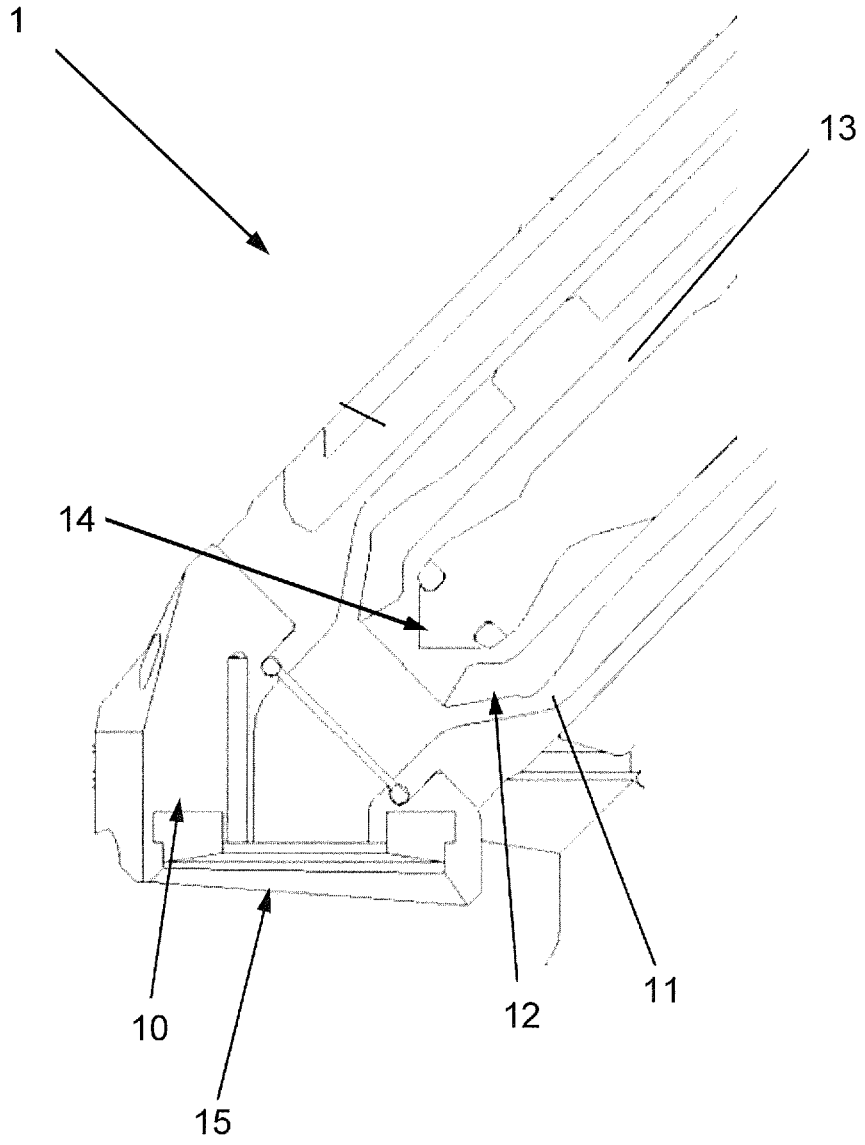
FIG. 2 shows a cross-sectional view of a filling member which has a filling valve and a gas channel.

In order to flush the container 4 and/or to pressurize and/or to discharge the atmosphere in the container 4 in a controlled manner during filling and optionally during pressure relief, the filling valve 12 has the aforementioned gas channel which is not specifically illustrated in FIG. 1 but is shown in the exemplary embodiment of FIG. 2.

FIG. 2 shows a cross-sectional view of an exemplary filling member 1. The filling member 1 has, received in a valve base body 10: a filling product line 11 which is fluidically connected to the product tank 2; the filling valve 12 which is arranged on the lower, i.e. downstream, end of the filling product line 11; the aforementioned gas channel 13; and a gas valve 14 which is arranged on the lower end of the gas channel 13.

Via the gas channel 13 and the gas valve 14, the container 4 may be flushed and/or pressurized with a gas, namely inert gas, nitrogen and/or carbon dioxide. Moreover, the container interior may be also set to a desired pressure, for example evacuated. The discharged gas may be conducted entirely or partially into the head space 2*a* of the product tank 2. The gas channel 13 may have a multichannel construction, for example by means of a tube-in-tube construction it may include a plurality of gas lines in order to separate physically the supply of one or more gases into the container 4 and/or the discharge of gas from the container 4, if required.

The gas valve 14 includes, for example, a gas valve cone and a gas valve seat which are designed to regulate the gas throughflow. To this end, the gas valve cone is switchable via an actuator, not shown.

The filling product line 11 is typically designed as an annular line which extends substantially concentrically to the gas channel 13. The filling valve 12 includes, for example, a filling valve cone and a filling valve seat which are designed to regulate the throughflow of filling product. The filling valve 12 is designed to permit a complete blocking of the filling product flow. In the simplest case, the filling valve 12 has two positions, an open position and a fully closed position. To this end, the filling valve 12 is switchable via an actuator, not shown.

The actuation of the gas valve 14 and the filling valve 12 is carried out via actuators, not shown in more detail. It should be mentioned that the gas valve 14 and the filling valve 12 may be operatively connected together so that for example an actuator may be designed for common use, in order to simplify the construction of the filling member 1 and to increase the reliability.

At the outlet end of the media, the filling member 1 has a neck portion 15 which is designed such that the container neck may be moved sealingly against the neck portion 15. To this end, the neck portion 15 generally has a centering bell with a suitably shaped rubber contact seal. The filling member 1 with the neck portion 15 is designed for so-called wall filling, in which the filling product flows downwardly on the container wall after exiting from the neck portion 15. In some embodiments, the filling product line 11 and the neck portion 15 are designed, or have corresponding means, such that the filling product is swirled during filling, whereby the filling product is driven outwardly due to centrifugal force and after emerging from the neck portion 15 flows downwardly in a spiral movement.

It should be mentioned that the spatial terms, such as for example "beneath", "below", "over", "above", "downwardly", etc. refer to the installed position of the filling member 1, which is clearly determined by the direction of gravity.

The construction of the filling member 1 shown in FIG. 2 is only by way of example. The filling member 1 may have any suitable construction provided it is equipped with a gas channel 13 which is designed for flushing and/or pressurizing the container 4 and/or for discharging gas from the container 4.

Returning to FIG. 1 a measuring apparatus 80 is provided for analyzing the gas atmosphere in the head space 2*a* of the product tank 2. The measuring apparatus 80 has at least one gas sensor 81 herein, which is designed for determining the gas composition in the head space 2*a* of the product tank 2 or which contributes thereto. Thus the gas sensor 81 is generally designed to measure the quantity of oxygen in the product tank 2 and/or the head space 2*a* thereof.

The measuring apparatus 80 is communicatively coupled to a control apparatus 90 which is an electronic apparatus for monitoring and controlling the carousel-type filling machine 100. To this end, the control apparatus 90 also communicates with actuators of the carousel-type filling machine 100, such as for example the filling valves 12, in order to control the treatment process of the containers 4. The data transmission may take place in a wireless or wired manner.

The sensor system including the measuring apparatus 80 and the control apparatus 90 permits the determination of the gas composition in the head space 2*a* of the product tank 2 fully or at least partially, and for conclusions to be drawn about the process performance. Thus, for example, the residual oxygen in the product tank 2 may be regarded as a measurement or indicator of the oxygen content in the container 4 to be filled, since this passes into the product tank 2 by displacement by the filling product. The residual oxygen in the product tank 2, therefore, may function as a process performance parameter. If the oxygen content in the product tank 2 rises, an impairment to the product quality may be counteracted by the treatment process being optimized. This may be achieved, for example, by lengthening the flushing time of the container 4, optimizing the vacuum in the container 4 or pressurizing the container 4.

The monitoring of the gas atmosphere in the product tank 2 provides an independence from expensive and often unreliable analysis devices which are only able to establish a reduction in quality retrospectively, i.e. on the filled product. The optimization of the treatment process including, for example, the flushing and/or pressurizing as well as the filling of the containers 4 may be carried out in real time and in an automated manner, whereby the effort of a retrospective quality control may be eliminated or at least reduced. Thus fewer filled containers 4 have to be retrospectively rejected.

The effects of different gas compositions on the filling may be examined in a targeted manner. Faulty processes may be automatically detected and superfluous process steps, for example evacuation and $CO_2$ flushing, may be optimized or even eliminated. In this manner, not only the process sequence may be optimized as a whole but the consumption of resources, for example the $CO_2$ consumption, may be minimized.

If applicable, all of the individual features which are shown in the exemplary embodiment may be combined together and/or exchanged without departing from the scope of the invention.

The invention claimed is:

1. A device for filling a container with a filling product, comprising:

a product tank configured to provide the filling product, wherein a head space with a gas atmosphere is located above the filling product in the product tank;

at least one filling member configured to introduce the filling product from the product tank into the container comprising:

a filling valve that is fluidically connected to the product tank, and a gas channel configured to treat the container with a first gas and/or to discharge a second gas from the container;

a measuring apparatus configured to analyze the gas atmosphere in the head space of the product tank; and a control apparatus:

that is communicatively coupled to the measuring apparatus and that is configured to determine a process performance parameter from an analysis, by the measuring apparatus, of the gas atmosphere in the head space of the product tank, and to alter a treatment of the container in response to a determination, by the control apparatus, of the process performance parameter, wherein the treatment comprises a filling, flushing, and/or pressurizing of the container with the first gas or the second gas.

2. The device of claim 1, wherein the process performance parameter comprises a quality of the filling product in a filled container.

3. The device of claim 1, wherein the first gas or second gas comprises carbon dioxide, nitrogen, or oxygen.

4. The device of claim 1, wherein the gas channel is fluidically connected to the product tank so that gas that is displaced from the container during a filling process or released during a depressurization of the container after the filling process passes through the gas channel into the head space of the product tank.

5. The device of claim 1, wherein the measuring apparatus comprises a gas sensor that is configured to determine a gas composition in the head space of the product tank or a type of gas that contributes to the gas composition in the head space of the product tank.

6. The device of claim 5, wherein the gas sensor comprises an oxygen sensor, and the control apparatus is further configured to determine the process performance parameter by analyzing a quantity of oxygen in the head space of the product tank.

7. The device of claim 6, wherein when the quantity of oxygen is rising in the head space of the product tank, the control apparatus is further configured to lengthen a flushing time of the container with a flushing gas, to optimize a vacuum in the container, and/or to optimize a pressurizing of the container.

8. The device of claim 7, wherein the control apparatus is further configured to lengthen the flushing time of the container with the flushing gas, and the flushing gas comprises carbon dioxide.

9. A method for filling a container with a filling product, comprising:

providing the filling product in a product tank, wherein a head space with a gas atmosphere is located above the filling product in the product tank;

introducing the filling product into the container through a filling valve of a filling member, wherein the filling member comprises a gas channel configured to treat the container with a first gas before filling and/or to discharge a second gas from the container;

analyzing, by a measuring apparatus, the gas atmosphere in the head space of the product tank;

determining, by a control apparatus that is communicatively connected to the measuring apparatus, a process performance parameter from the analysis of the gas atmosphere in the head space of the product tank; and altering, by the control apparatus, a treatment of the container in response to a determination, by the control apparatus, of the process performance parameter, wherein the treatment comprises a filling, flushing, and/or pressurizing of the container with the first gas or the second gas.

10. The method of claim 9, wherein the process performance parameter comprises a quality of the filling product in a filled container.

11. The method of claim 9, wherein the first gas or the second gas comprises carbon dioxide, nitrogen, or oxygen.

12. The method of claim 9, wherein the gas channel is fluidically connected to the product tank so that gas that is displaced from the container during a filling process or released during depressurization of the container after the filling process passes through the gas channel into the head space of the product tank.

13. The method of claim 9, wherein the measuring apparatus comprises a gas sensor, and analyzing the gas atmosphere in the head space of the product tank comprises determining a full or partial gas composition in the head space of the product tank.

14. The method of claim 13, wherein the gas sensor comprises an oxygen sensor, and analyzing the gas atmosphere in the head space of the product tank comprises analyzing a quantity of oxygen in the head space of the product tank.

15. The method of claim 14, further comprising:

lengthening a flushing time of the container with a flushing gas;

optimizing a vacuum in the container; and/or optimizing a pressurizing of the container when the quantity of oxygen is rising in the head space of the product tank.

16. The method of claim 15, wherein the flushing time of the container with the flushing gas is lengthened, and the flushing gas comprises carbon dioxide.

17. A device for filling a container with a filling product, comprising:

a product tank configured to provide the filling product, wherein a head space with a gas atmosphere is located above the filling product in the product tank;

at least one filling member configured to introduce the filling product from the product tank into the container comprising:

a filling valve that is fluidically connected to the product tank, and a gas channel configured to treat the container with a first gas and/or to discharge a second gas from the container;

a measuring apparatus configured to analyze the gas atmosphere in the head space of the product tank, wherein the measuring apparatus comprises an oxygen sensor that is configured to determine a gas composition in the head space of the product tank or a gas that contributes to the gas composition in the head space of the product tank; and a control apparatus:

that is communicatively coupled to the measuring apparatus and that is configured to:

determine a process performance parameter from an analysis, by the measuring apparatus, of the gas atmosphere in the head space of the product tank, determine the process performance parameter by analyzing a quantity of oxygen in the head space of the product tank, and to lengthen a flushing time of the container with a flushing gas, to optimize a vacuum in the container, and/or to optimize a pressurizing of the container, when the quantity of oxygen is rising in the head space of the product tank.

18. The device of claim 17, wherein the control apparatus is further configured to lengthen the flushing time of the container with the flushing gas, and the flushing gas comprises carbon dioxide.

19. The device of claim 17, wherein the control apparatus is further configured to alter a treatment of the container in response to a determination, by the control apparatus, of the process performance parameter.

20. The device of claim 19, wherein the treatment comprises a filling, flushing, and/or pressurizing of the container with the first gas or the second gas.

* * * * *